United States Patent [19]

Adler et al.

[11] 4,181,945

[45] Jan. 1, 1980

[54] HIGH-RELIABILITY VEHICLE CONTROL SYSTEM

[75] Inventors: Reinhard Adler, Althengstett, Fed. Rep. of Germany; Henri Maatje, Oslo, Norway

[73] Assignee: International Standard Electric Corporation, New York, N.Y.

[21] Appl. No.: 869,726

[22] Filed: Jan. 16, 1978

[30] Foreign Application Priority Data

Jan. 19, 1977 [DE] Fed. Rep. of Germany ..... 2701925

[51] Int. Cl.[2] ..... B61L 27/00; G06F 15/50

[52] U.S. Cl. ..... 364/436; 364/424; 235/307

[58] Field of Search ..... 364/424, 436, 200, 900; 235/307

[56] References Cited

U.S. PATENT DOCUMENTS

| | | | |
|---|---|---|---|
| 4,012,717 | 3/1977 | Censier et al. | 235/307 |
| 4,030,074 | 6/1977 | Giorcelli | 235/307 |

FOREIGN PATENT DOCUMENTS

| | | | |
|---|---|---|---|
| 2710466 | 9/1977 | Fed. Rep. of Germany | 235/307 |

OTHER PUBLICATIONS

Costa et al.: Sao-Paulo Metro E-W Line Innovations IEEE Industry Applications Society Annual Meeting Oct. 26, 1977, pp. 1105-1109.

*Primary Examiner*—Felix D. Gruber

*Attorney, Agent, or Firm*—John T. O'Halloran; Alfred C. Hill

[57] ABSTRACT

A vehicle control system is disclosed which comprises a center and a plurality of vehicles carrying two redundant computer systems as on-board control equipment. Each of the computer systems consists of two computers which compare their results and deliver them only if they agree. Which of the two computer systems processes the telegrams received from the center and compiles telegrams to the center from messages of the on-board units is determined from the center. At regular intervals switchover to the other computer system is effected to check whether the latter is functioning correctly or not. Any failure in one computer system need no longer result in the application of the emergency brakes. However, a fault message is sent to the center, and the vehicle is directed to the maintenance shop at the end of the movement.

7 Claims, 1 Drawing Figure

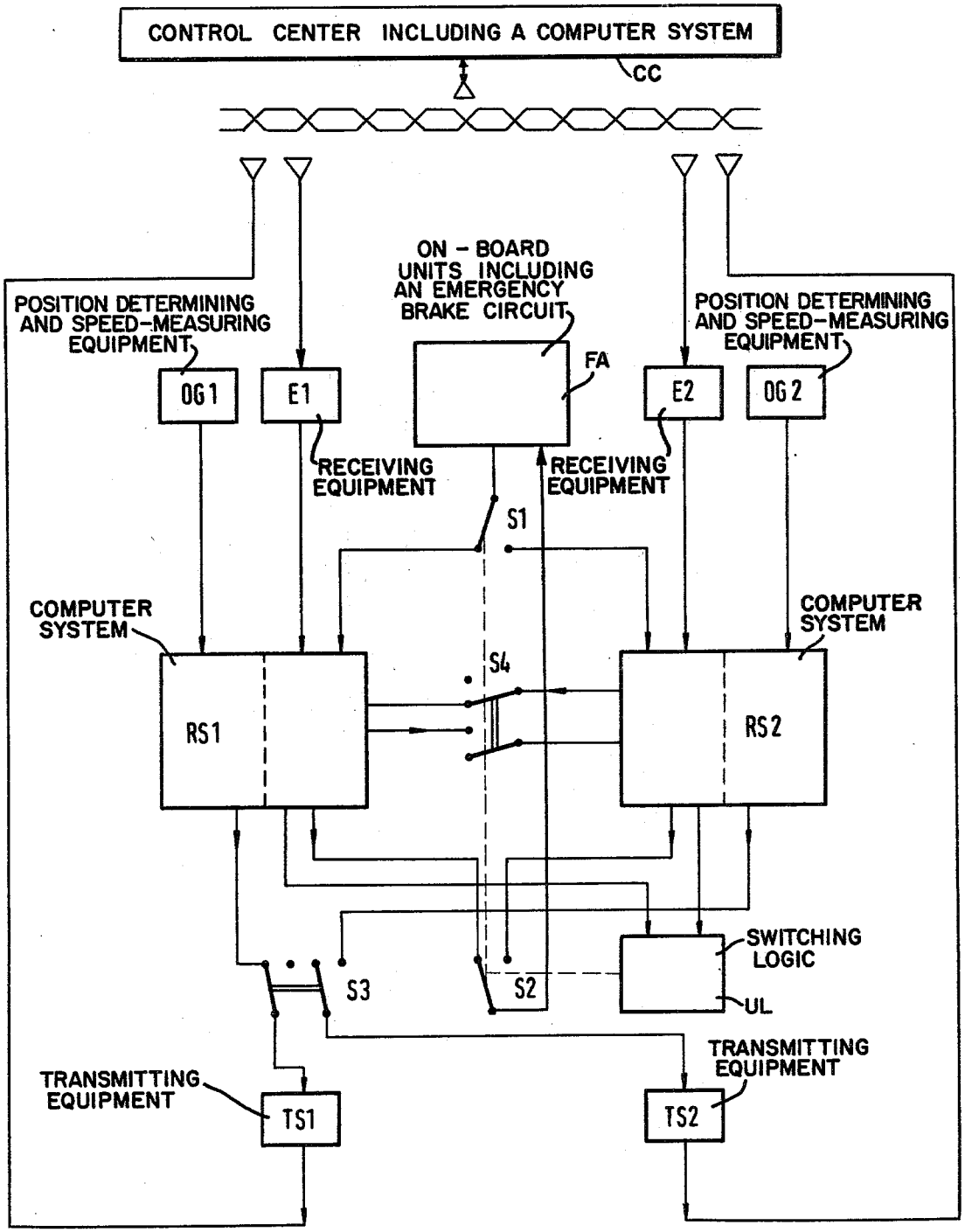
CONTROL CENTER INCLUDING A COMPUTER SYSTEM
CC
ON - BOARD UNITS INCLUDING AN EMERGENCY BRAKE CIRCUIT
FA
POSITION DETERMINING AND SPEED-MEASURING EQUIPMENT
OG1
E1
RECEIVING EQUIPMENT
E2
OG2
S1
COMPUTER SYSTEM
RS1
S4
RS2
SWITCHING LOGIC
UL
S3
S2
TRANSMITTING EQUIPMENT
TS1
TS2

HIGH-RELIABILITY VEHICLE CONTROL SYSTEM

BACKGROUND OF THE INVENTION

The present invention relates to a vehicle control system comprising at least one contive center and a plurality of track-bound vehicles with on-board control equipment which exchanges data telegrams with a computer system located at the contive center.

U.s. Pat. No. 4,015,804, whose disclosure is incorporated herein by reference, having a Claim for Priority based on German Patent Application No. 2,423,490, filed May 15, 1974, discloses a hierarchically organized, demand-controlled vehicle control system wherein the individual vehicles are controlled from, and safety responsibility lies with, so-called command and control centers, while a higher-level operation control center takes care of demand control and of the station equipment.

The operational reliability of such a system is dependent primarily on the reliability of the on-board control equipment. This equipment has so far been built with fail-safe circuits which are developed specifically for conventional continuous (long-have) automatic train control systems. Such fail-safe circuits require that the on-board control equipment made redundant by providing duplicate functional units, with each of the duplicated units performing only a relatively few functions.

The demand-controlled vehicle control system of the above-cited U.S. Patent uses unmanned vehicle units which are smaller and run at much shorter headways (distance between adjacent vehicle units) than those employed in the conventional continuous automatic train control system. Since the data transmission time available to the individual vehicle is much shorter, the on-board control equipment must, on its own responsibility, perform many functions previously implemented in the control center of the conventional continuous automatic train control systems, as well as additional tasks resulting from the demand control and the receipt of passenger requests. If of conventional design, such on-board control equipment would be much too expensive to implement an economically efficient demand-control, short-distance traffic system, the more so since the number of vehicles and, consequently, the number of on-board control units required, related to the number of passengers transported, is much greater than in the conventional continuous automatic train control system.

Another problem, which is caused by the absence of staff on the vehicles, is the risk of controlled track sections being blocked in the event of a failure of on-board equipment. The only solution to this is the additional provision of automatically connectable standby equipment or, if the existing on-board control equipment consists of two identical units, the provision of at least a third such unit which can be automatically put into operation in the event of a failure. This further increases the cost of the on-board control equipment and, thus, of the whole vehicle control system and requires a considerable amount of on-board circuitry whose performance, like that of the standby circuits, cannot be checked before it is put into operation in the event of a malfunction, which results in a relatively high probability of section blockings.

SUMMARY OF THE INVENTION

The object of the invention is to provide a safe and extremely reliable vehicle control system which is much more efficient and lower in cost than conventional vehicle control systems and, therefore, is especially suited for a demand-controlled traffic system comprising many unmanned vehicle units.

A feature of the present invention is the provision of a vehicle control system comprising: at least one control center having a first computer system capable of generating first control data telegrams and responding to second control data telegrams; and a plurality of track-bound vehicles each having on-board control equipment in two-way communication with the first computer system to receive the first telegrams and to transmit the second telegrams; the equipment including first means to receive the first telegrams, second means to transmit the second telegrams, on-board units to be controlled, third means to determined the speed and position of an associated one of the vehicles, two identical computer systems each coupled to the first, second and third means and the units, the two computer systems receiving the first telegrams, status reports from the units and speed and position information from the third means to generate the second telegrams and to control the units in response to the first telegrams, and switching logic coupled to each of the two computer systems, the units and the second means responsive to a first output signal of one of the two computer systems selected by the first telegrams for control of the units and for delivery of the second telegrams to couple the second telegrams from the selected one of the two computer systems to the second means for transmission, to couple a second output signal of the selected one of the two computer systems to the units for control thereof, and to enable the first computer system to check the operation of each of the two computer systems by means of information contained in the second telegram.

Thus, each vehicle carries two inherently safe on-board computer systems which are identical, i.e. can perform all essential control functions independently of each other, and which are continuously monitored by the computer system located at the center, regardless of whether or not an on-board computer system has been selected for the delivery of data telegrams and control commands to the on-board units. In addition, in the event of a malfunction, it is possible to switch from one on-board computer system to the other while the vehicle is moving, so a failure of the computer system in charge of data telegram delivery and vehicle control will no longer result in the vehicle being brought to a stop and will hardly be perceived by the passengers. Since the computer system at the center is apprised of each malfunction, it can also cause the vehicle to be sent to the maintenance shop, thereby keeping the risk of a failure of both on-board computer systems, which would result in section blocking, very small.

A development of the vehicle control system according to the invention is characterized in that, as a sign of its perfect condition, each on-board computer system delivers like signals at regular intervals, that the presence of such live signals from both on-board computer systems is communicated to the computer system at the center within the data telegrams, which receives the live signal from the on-board computer system selected for data telegram delivery, and that the on-board computer system not selected for data telegram delivery delivers its live signals to the on-board computer system selected for data telegram delivery.

Thus, there is a safe and simple way for the computer system at the center of continuously checking whether the two on-board computer systems are functioning correctly.

Another development of the vehicle control system according to the invention relates to the system's operation in the selection of the individual on-board computer systems and is characterized in that the selection of an on-board computer system is effected by the computer system at the center by means of a special bit in each data telegram intended for the respective vehicle, that this bit enables the selected on-board computer system to also deliver its live signal to the switching logic, and that the switching logic switches through that on-board computer system for data telegram delivery and for control of the on-board units which is delivering live signals to the switching logic.

A further development of the vehicle control system according to the invention is characterized in that each vehicle carries an emergency brake circuit which receives the live signals of the on-board computer system selected for data telegram delivery and for control of the on-board units, that if the live signals fail to appear, the emergency brake is activated and not released again until the live signals of the other on-board computer system are received after switchover to this other system, that a failure of one on-board computer system or of an important on-board unit controlled by this on-board computer system as well as disagreement determined at least twice in a row between the results computed by the computers of an on-board computer system results in discontinuance of the delivery of live signals from the respective on-board computer system, and that the computer system at the center, if necessary, then causes the other on-board computer system to be switched through, and sends a trouble message to a higher-level operation control center which directs the vehicle to the maintenance shop at the end of its scheduled service. This ensures that a vehicle can continue its movement only if at least one on-board computer system and all important on-board units are functioning properly, and that a vehicle is withdrawn from service as soon as possible if a malfunction is detected, even if this malfunction occurs in a portion of the equipment which is not in use at that time.

Another development of the vehicle control system according to the invention is characterized in that for checking the switching logic, the computer system located at the center, switches the data telegram delivery and the on-board units at regular intervals to the other on-board computer system and subsequently the switching logic, too, is checked at regular intervals for correct operation, so that any failure of this logic will be noticed before a switchover has to be performed because one of the on-board computer systems is defective.

BRIEF DESCRIPTION OF THE DRAWING

Above-mentioned and other features and objects of this invention will become more apparent by reference to the following description taken in conjunction with the accompanying drawing, in which, the single FIGURE is a block diagram of the vehicle on-board equipment and control center of the vehicle control system in accordance with the principles of the present invention.

DESCRIPTION OF THE PREFERRED EMBODIMENT

The Figure shows on-board vehicle equipment including the computer systems RS1 and RS2 each including two computers, such as an ITT 1650-65 stored-program digital computer, and a comparator as disclosed in the above-identified U.S. patent.Each of the computer systems RS1 and RS2 is permanently coupled to an associated one of the receiving equipment E1 and E2 for receiving data telegrams from a control center CC, position-determining and speed-measuring equipment OG1 and OG2, and transmitting equipment TS1 and TS2 for transmitting data telegrams to the control center CC, the control center CC being implemented as disclosed in the above-cited U.S. patent. Electromechanical switches S1 to S4, such as relays, are controlled from a switching logic UL and switch the data telegram delivery and the on-board units to one or the other of the on-board computer systems RS1 and RS2. The switch S1 switches the reporting path, and the switch S2 the command path, to the on-board units FA between the on-board computer systems RS1 and RS2. The switch S3 connects the data telegram outputs of the on-board computer systems RS1 and RS2 to the associated transmitting equipment or disconnects these outputs from this equipment, and the switch S4 switches the trouble reporting path between the two on-board computer systems RS1 and RS2.

In operation, a computer system located at control center CC cyclically transmits to all vehicles data telegrams which are received by both on-board computer systems RS1 and RS2 via the receiving equipment E1 and E2 associated with them. The on-board computer systems RS1 and RS2 also receive status reports from the position-determining and speed-measuring equipment OG1 and OG2 associated with them. The on-board computer system switched through for data telegram delivery and vehicle control additionally receives status reports from the switchable on-board units FA. Both on-board computer systems RS1 and RS2 generate control commands from the data telegrams, received from control center CC by receiving equipment E1 and E2 and the selected on-board computer system switched through to the command path via the switch S2 delivers these control commands to the on-board units FA. From the status reports provided by on-board units FA and equipments OG1 and OG2, the selected on-boardcomputer system RS1 and RS2 compiles data telegrams for the center CC which are delivered to the transmitting equipment TS1 and TS2 associated with it via switch S3 for transmission to control center CC.

All operations of an on-board computer system are performed in both computers independently of each other. At the end of each arithmetic operation, the results are exchanged and compared in the two computers. If the results agree and both the received data telegrams and the status reports are acceptable, the on-board computer system RS1 and RS2 generates a live signal, e.g. a sequence of pulses, which is continued until an error occurs. The presence of such live signals in both on-board computer systems is communicated to the center CC. To this end, special bits are provided in the data telegrams delivered by one of the two on-board computer systems to the centre, and there is provided a data line which is switchable with the switch S4 and over which the two on-board computer systems can deliver their live signals to each other.

The selection of an on-board computer system for data telegram delivery and the control of the on-board units are effected by means of a selection bit in all data telegrams from the center CC which are addressed to the respective vehicle. The selection bit enables an on-board computer system to deliver its live signal to the switching logic UL, too. The switching logic UL then switches the switches S1 to S4 so that the on-board computer system RS1 or RS2 delivering its live signal to the switching logic UL is switched through for data telegram delivery and for the control of the on-board units FA.

The fact that switchover has taken place is communicated to the center CC by means of a special bit within the transmitted data telegrams which informs the center CC which on-board computer system has delivered the respective data telegram. If no switchover has taken place, a movement to the maintenance shop is initiated.

Among the on-board units FA receiving control commands from the on-board computer systems is an emergency brake circuit, which is not shown in the Figure. This circuit holds off the emergency brake as long as it receives a live signal from the selected on-board computer system. If a failure occurs in the on-board computer system switched through to the on-board units, this system discontinues the delivery of life signals, and the emergency brake circuit activates the emergency brake. As soon as switchover to the other on-board computer system has taken place and the emergency brake circuit receives the live signals of that other computer system, the emergency brake is released, and a fault message is sent to the center CC with the next data telegram. The center CC, in turn, informs a higher-level operation control center which directs the vehicle to the maintenance shop at the end of a running command which the vehicle has started to execute.

It is also possible, however, that a malfunction occurs in that on-board computer system not presently switched through for data telegram delivery and for vehicle control. In this case, the emergency brake will not be activated. However, the on-board computer system concerned stops the delivery of life signals, which is noticed by the other on-board computer system and, as in the above case, triggers an error message to the center CC.

Malfunctions resulting in controlled track section blocking can occur only at the common on-board units, mainly in the propulsion and brake systems of the vehicles, and in rare cases when both on-board computer systems fail simultaneously or in rapid succession.

While we have described above the principles of our invention in connection with specific apparatus it is to be clearly understood that this description is made only by way of example and not as a limitation to the scope of our invention as set forth in the objects thereof and in the accompanying claims.

What is claimed is:

1. A vehicle control system comprising:

at least one control center having a first computer system capable of generating first control data telegrams and responding to second control data telegrams; and a plurality of track-bound vehicles each having on-board control equipment in two-way communication with said first computer system to receive said first telegrams and to transmit said second telegrams;

said equipment including first means to receive said first telegrams, second means to transmit said second telegrams, on-board units to be controlled, third means to determine the speed and position of an associated one of said vehicles, two identical computer systems each coupled to said first, second and third means and said units, said two computer systems receiving said first telegrams, status reports from said units and speed and position information from said third means to generate said second telegrams and to control said units in response to said first telegrams, and switching logic coupled to each of said two computer systems, said units and said second means responsive to a first output signal of one of said two computer systems selected by said first telegrams for control of said units and for delivery of said second telegrams to couple said second telegrams from said selected one of said two computer systems to said second means for transmission, to couple a second output signal of said selected one of said two computer systems to said units for control thereof, and to enable said first computer system to check the operation of each of said two computer systems by means of information contained in said second telegram.

2. A system according to claim 1, wherein each of said two computer systems delivers a first output signal at regular intervals to indicate the proper operation thereof, the other of said two computer systems coupling its first output signal to said selected one of said two computer systems, and said selected one of said two computer systems providing an indication of the presence of said first output signals in said second telegram for transmission to said first computer system to enable said first computer system to check the operation of each of said two computer systems.

3. A system according to claim 2, wherein said first computer system provides a special bit in each of said first telegrams addressed to said associated one of said plurality of vehicles, said special bit being employed to select said selected one of said two computer systems and to gate said first output signal of said selected one of said two computer systems to said switching logic for actuation thereof to switch said second telegram delivered by said selected one of said two computer systems to said second means.

4. A system according to claim 3, wherein said units include a normally inoperative emergency brake circuit maintained inoperative by said first output signal from said selected one of said two computer systems, said brake circuit being rendered operative when said first output signal disappears, disappearance of said first signal indicating a failure in said selected one of said two computer systems, said failure indication being transmitted to said first computer system by said second telegram, said first computer system responding to said failure indication causing said switching logic by means of said first telegram to switch said other of said two computer systems to said second means and to couple said first signal of said other of said two computer systems to said brake circuit to again render said brake circuit inoperative.

5. A system according to claim 4, wherein at regular intervals said first computer system by means of said special bit selects said other of said two computer systems to check by means of information in said second telegram whether switchover has been performed by said switching logic.

6. A system according to claim 5, wherein said first means includes two receiving equipments each permanently connected to a different one of said two computer systems, said second means includes two transmitting equipments each selectively connected to a different one of said two computer systems by said switching logic, and said third means includes two position-determining and speed-measuring equipments each permanently connected to a different one of said two computer systems.

7. A system according to claim 6, wherein said switching logic includes a first electromechanical switch to couple said status reports from said units to only said selected one of said two computer systems, a second electromechanical switch to couple said second output signal from only said selected one of said two computer systems to said units, and a third electromechanical switch to couple said second telegram fron only said selected one of said two computer systems to an associated one of said two transmitting equipments.

* * * * *